United States Patent [19]

Smyth

[11] Patent Number: 4,759,494

[45] Date of Patent: Jul. 26, 1988

[54] LIQUID-PROOF ENVELOPE WITH ATTACHED IDENTIFICATION FORM

[76] Inventor: Stuart J. Smyth, 5, Marnabrae, Belsize Road, Lisburn, BT27 4LD, Northern Ireland

[21] Appl. No.: 908,248

[22] Filed: Sep. 17, 1986

[51] Int. Cl.[4] ..... B65D 27/00; B65D 33/00

[52] U.S. Cl. ..... 229/70; 206/459; 206/466; 206/831; 229/74; 383/94; 383/108

[58] Field of Search ..... 229/70, 74; 206/831, 206/459, 466; 383/25, 94, 106, 107

[56] References Cited

U.S. PATENT DOCUMENTS

| | | | |
|---|---|---|---|
| 1,206,417 | 11/1916 | Cunkle | 229/74 |
| 1,212,128 | 1/1917 | Chamberlin et al. | 229/74 X |
| 1,323,578 | 12/1919 | Cardinell | 229/74 |
| 1,466,658 | 9/1923 | Jones | 229/74 X |
| 1,880,277 | 10/1932 | Pinkerton, Jr. | 383/108 |
| 2,224,455 | 12/1940 | Hoffmann | 229/74 X |
| 2,303,296 | 11/1942 | Avery | 229/70 X |
| 2,516,978 | 8/1950 | Gottesman | 383/108 |
| 2,542,245 | 2/1951 | Gottesman | 383/107 |
| 3,905,477 | 9/1975 | Graham . | |

FOREIGN PATENT DOCUMENTS

| | | |
|---|---|---|
| 1096222 | 12/1967 | United Kingdom . |
| 1354954 | 5/1974 | United Kingdom . |
| 1444285 | 7/1976 | United Kingdom . |

*Primary Examiner*—Stephen P. Garbe

*Attorney, Agent, or Firm*—Murray and Whisenhunt

[57] ABSTRACT

Packaging article comprising a form having at least one straight side for identification data to be provided thereon and an envelope attached to the straight side of the form. The envelope is internally liquid proof and has an open side and an interior for containing an article or mass therein. A self adhesive seal is provided at the open side for enabling the envelope to be manually closed at the open side so as to make the interior liquid tight after location of an article or mass therein.

6 Claims, 2 Drawing Sheets

LIQUID-PROOF ENVELOPE WITH ATTACHED IDENTIFICATION FORM

BACKGROUND OF THE INVENTION

This invention relates to packaging means for use where there is a requirement for articles including parts and fittings, specimens including samples and mass, to be delivered intact together with a form bearing all the necessary identification data relevant to that article or specimen. Such a use may be in packaging machine parts and fittings, or may more particularly, but not exclusively, be for use in delivering, from a point of receipt i.e.. a clinic or surgery, or a site to a point of investigation/testing i.e.. a laboratory, liquid laboratory specimens or samples of, for example blood or urine taken from a patient whether human or animal. The specimens can also be of soil samples of ashes or other particles requiring forensic examination.

The requirement is for such specimens to be delivered intact together with a form bearing all the necessary identification data of the patient or location attached thereto. Preferably, the form and specimen do not come into contact with each other. Due to mishandling in transit between the two locations, spillages and sometimes breakages do occur and in such occasions the following problems possibly result:

1. Handlers can become exposed to infection;
2. The specimen can be rendered useless;
3. The pertaining form can be contaminated;
4. Other adjacent forms and specimens can become contaminated;
5. Considerable time and effort can be expended in obtaining another specimen from the patient or site concerned, and also from any other patient or site due to the contamination of the first specimen being rendered useless by breakage of the adjacent container.

Heretofore, methods of delivering such specimens have ranged from simply wrapping the form around a bottle with the specimen therein, the form being held therearound with an elastic band, to a closable paper envelope for a specimen bottle with the delineations of a form printed thereon or with a form attached thereto, such envelope not however being liquidtight. These methods and means do not overcome the problems associated with spillages and/or breakages.

SUMMARY OF THE INVENTION

It is an object of the present invention to provide packaging means to obviate or mitigate these problems.

In accordance with one aspect of the present invention, packaging means comprise a form for identification data to be written thereon, an envelope having a closable open side for containing an article or specimen, the form and envelope both having at least one common straight side and are secured at the common sides in side-to-side relationship to form an elongate package, the securing being by adhesion. In accordance with a second aspect of the present invention, packaging means comprise a form for identification data to be written thereon, an envelope having a closable open side for containing an article or specimen, the form and envelope both having at least one common straight side and are secured at the common sides in side-to-side relationship to form an elongate package, the form, along said common side, having a series of apertures and the envelope being of fusible material, the securing of the form to the envelope being by heat sealing the envelope to itself through said apertures. The envelope is internally liquid proof and closable in a manner to make the interior liquidtight. The form and envelope are each conveniently of rectangular shape, and of the same or substantially the same length dimension along said common side.

BRIEF DESCRIPTION OF THE DRAWINGS

An embodiment of the present invention will now be described, by way of example, with reference to the accompanying drawings in which.

DESCRIPTION OF THE PREFERRED EMBODIMENT

Figure 2:
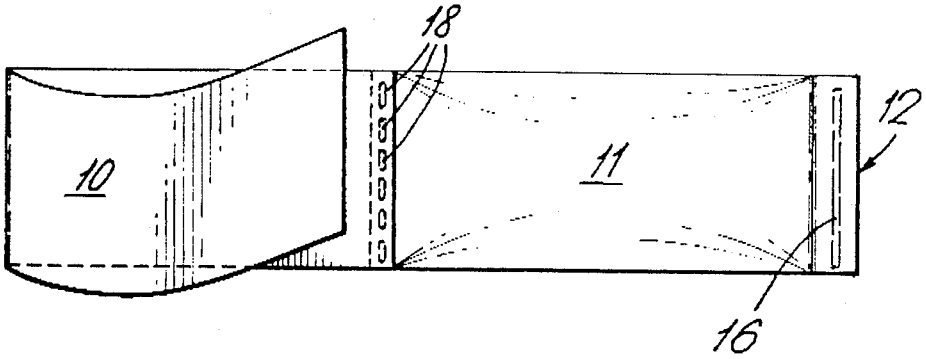
FIG. 2 is a plan view of the packaging means showing a second type of closure for the envelope with the envelope and form secured by the first method.
Figure 3:
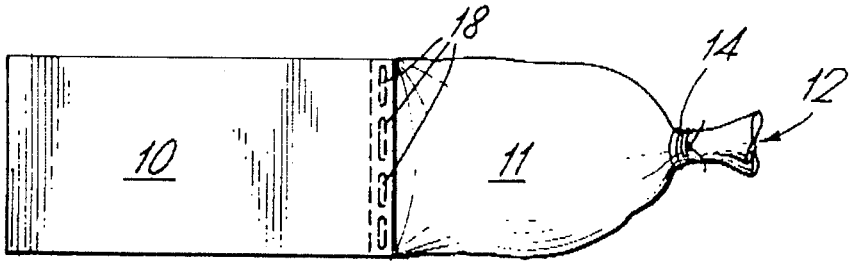
FIG. 3 is a plan view of the packaging means showing a third type of closure for the envelope with the envelope and form secured by the first method.
Figure 4:
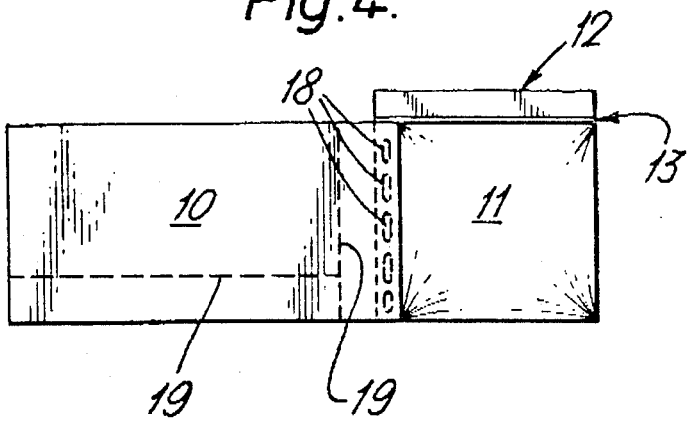
FIG. 4 is a plan view of the packaging means showing a fourth type of closure for the envelope with the envelope and form secured by the first method.
Figure 5:
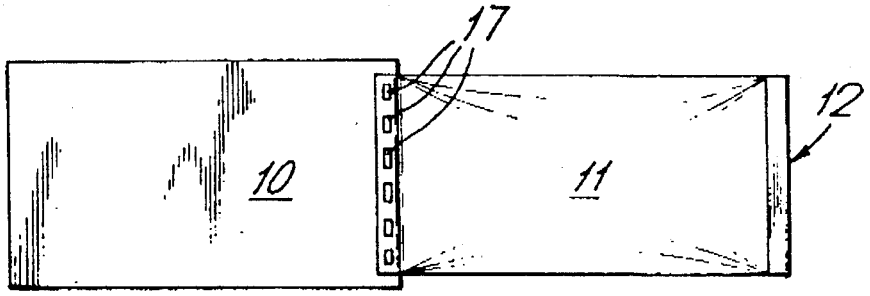
FIG. 5 is a plan view of the packaging means showing a second method of securing the envelope to the form.

Referring to the drawings, the packaging means comprises a rectangular printed form 10 delineated across its area to provide boxes for identification data, the form 10 being of single ply or multiple plies attached at one side. A rectangular envelope 11 having a closable open side is provided. The form and envelope both have a common side of same length dimension and they are secured together at their common sides in side-to-side relationship to provide an elongate package with the open side 12 of the envelope at the opposite side to the common side as shown in FIGS. 1,2,3, or 5, or at one of the sides as shown in FIG. 4. The envelope is to hold an article or specimen in a bottle or bag and is internally liquid-proof of, for example plastics material, and is closable at said open side 12 in a manner to make the interior of the envelope liquidtight.

The methods of securing the envelope to the form can be by a first method of strip or spot adhesive 18 of the envelope to the reverse of the form, or by a second method for use in the case where the envelope is of fusible plastics material, for example polythene, of providing a row of apertures 17 adjacent the common side of the form, reflexively folding the envelope over upon itself on both faces of the form overlying the apertures 17 and welding or heat sealing the envelope to itself through the apertures.

Figure 1:
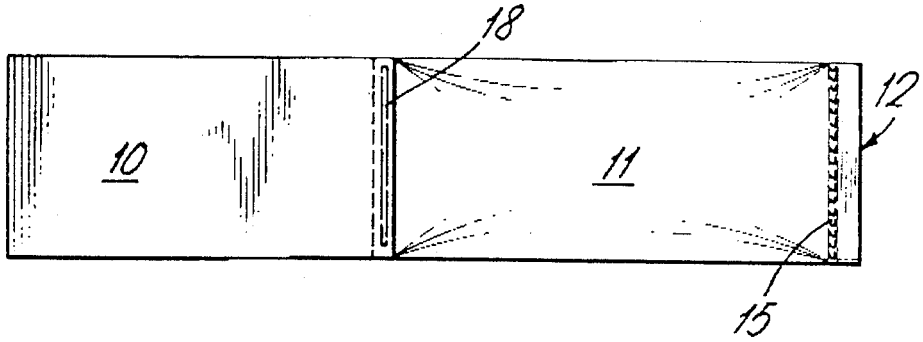
FIG. 1 is a plan view of packaging means according to the present invention, showing a form and an envelope having one type of closure and being secured by a first method.

The methods of closure of the open side of the envelope can be:

1. By using a heat seal unit to seal the opening of the fusible material of the envelope as shown in FIG. 1 to produce a weld 15;

2. By using a self-adhesive strip 16 on a flap 20 at the opening of the envelope as shown in FIG. 2;

3. By using a light grade material, the envelope can simply be tied in a knot 14 at the open side as shown in FIG. 3 (this provides a simple effective seal);

4. By using an envelope with integral mating profiled strip 13 one on each major inside face of the envelope adjacent the open side as shown in FIG. 4; or 5. By simply sealing the envelope with a self-adhesive tape or label 21 in a manner to make the envelope liquid-tight.

The packaging means can be manufactured in various ways, viz

1. A simple one ply paper form and an envelope of plastics material;

2. A multi-ply paper form i.e. a form made of self-copy paper with one or several copies and attached to an envelope of plastics material; and 3. A multi-ply form of treated plastics material attached to an envelope of plastics material. In this latter case, the form would be perforated in such a way that on receipt of that article/specimen, the form can be detached from the envelope and by tearing off other perforations 19 a form size can be arrived at, which will conform to the size required to enable it to be used on, for example a Coulter Blood Analyser. In this case, the envelope may be made an integral part of the form. In use, the article/specimen is placed in the envelope which is sealed in one or other of the above methods and the relevant identification data is written on the form. For convenience, particularly where the envelope encloses a bottle with liquid content, the form at the side secured to the envelope can be perforated at 19 along a line inside that part of the form secured to the envelope whereby on receipt at the laboratory the form can be detached from the package, the envelope opened, bottle removed and placed on top of the form and envelope discarded to waste. If any spillage has occured then a proper method of removal from the envelope can be used with minimum risk of infection to the handler, the remaining part of the specimen still then being usable since it has not been contaminated during transit.

The form can be of paper, however it is anticipated that a treated plastic could be used for the form. The envelope can be made from fusible plastics material or material having the properties of plastics i.e. flexibility, and fluid retention/liquidproof characteristics and fusibility.

In addition to the first and second methods of securing the envelope to the form the following methods can be employed:

1. By stitching;

2. By taping; or

3. By stapling—i.e. with metal or plastic staples.

The invention described above is advantageous over existing packaging means in that 1. Where the specimen is a liquid, it minimises the possibility of handlers, such as hospital porters and laboratory personnel and others handling the specimens from contracting infectious diseases, especially hepatitus;

2. There is certainty that the form and specimen will arrive together at the laboratory;

3. It prevents cross contamination of other specimens and forms being transported together when a breakage or spillage occurs;

4. It saves laboratory time in sorting the specimens and forms. (The saving in time is thought to be considerable);

5. It reduces time, effort and expense in having to submit further specimens in the case of loss of form or contamination to previously obtained specimens.

The packaging means of the present invention can be used in which the form can be of small areal dimensions relative to the envelope and be of a size to receive minimum identification data, such an embodiment being of use for freezing an article(s) or a mass. Normally, in use the envelope is folded over behind the form.

I claim:

1. Packaging means, comprising:

a form for identification data to be provided thereon, said form having at least one straight side;

an envelope attached to said straight side of said form, said envelope being internally liquid proof and having an open side and an interior for containing an article or mass therein; and self-adhesive means provided on said open side for enabling said envelope to be manually closed at said open side to make said interior liquid tight after location of said article or mass therein.

2. Packaging means according to claim 1, wherein said form and said envelope are of rectangular shape of substantially the same length dimension along one side and are secured in side-to-side relationship to form an elongate package.

3. Packaging means according to claim 1 or 2, wherein said form and said envelope are secured together by adhesive.

4. Packaging means according to claim 1 or 2, wherein said form, along one side, has a series of apertures and an envelope of fusible material is secured thereto by heat sealing said envelope to itself through said apertures.

5. Packaging means according to claim 1 or 2, wherein said self-adhesive means is a self-adhesive strip on a flap to be closed over said open side in a manner to make said envelope liquid tight.

6. Packaging means according to claim 1 or 2, wherein said self-adhesive means is a self-adhesive tape or label to be adhered over said open side to make said envelope liquid tight.

* * * * *